United States Patent [19]

Crane

[11] 4,273,548

[45] Jun. 16, 1981

[54] METHOD AND DEVICE FOR FOLDING BLANKS TO FORM BOXES

[75] Inventor: Walton B. Crane, Sherman Oaks, Calif.

[73] Assignee: Industrial Designs & Services, Encino, Calif.

[21] Appl. No.: 81,633

[22] Filed: Oct. 4, 1979

[51] Int. Cl.[3] ..... B31B 1/26

[52] U.S. Cl. ..... 493/162; 493/456

[58] Field of Search ..... 93/49 M, 49 R, 55, 39 R, 93/36 M, 36 R, 51 R, 51 HW; 229/23 R; 493/162, 455, 456, 906

[56] References Cited

U.S. PATENT DOCUMENTS

| | | | |
|---|---|---|---|
| 3,487,914 | 1/1970 | Weaver et al. | 229/23 R X |
| 3,800,681 | 4/1974 | Corderoy | 93/52 X |
| 3,935,990 | 2/1976 | Crane | 229/23 R X |
| 3,978,774 | 9/1976 | Royal | 93/51 HW |
| 4,174,658 | 11/1979 | Graham | 93/51 HW |

FOREIGN PATENT DOCUMENTS

| | | | |
|---|---|---|---|
| 1064792 | 9/1959 | Fed. Rep. of Germany | 93/51 R |
| 619920 | 3/1949 | United Kingdom | 93/49 R |

*Primary Examiner*—James F. Coan

*Attorney, Agent, or Firm*—Fulwider, Patton, Rieber, Lee & Utecht

[57] ABSTRACT

A blank is folded to form a box by pressing it into a jig. End and side panels of the blank, along with supplemental panels at the corners, are lifted relative to a floor panel by folding surfaces of the jig. The side panels are lifted first and supplemental end panels are thus positioned inside the end panels. The blank may also include supplemental side panels that are folded outwardly and backwardly by corner guides of the jig.

19 Claims, 16 Drawing Figures

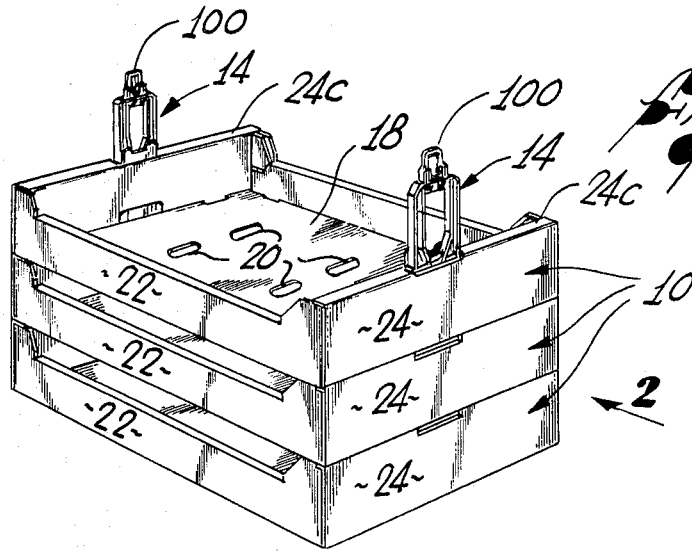
Fig. 1
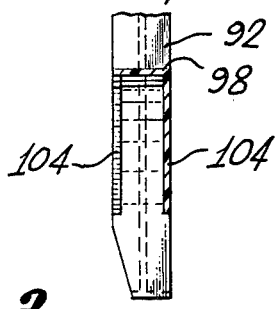
Fig. 4
Fig. 2
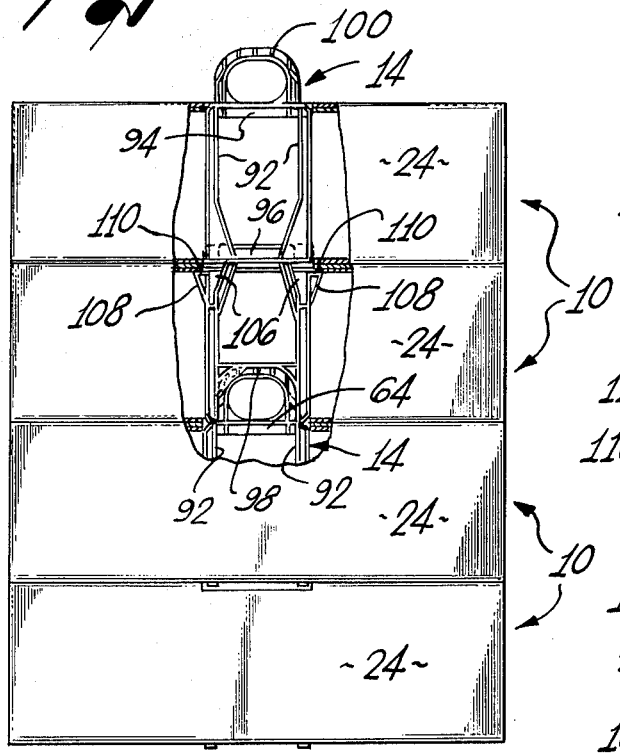
Fig. 3
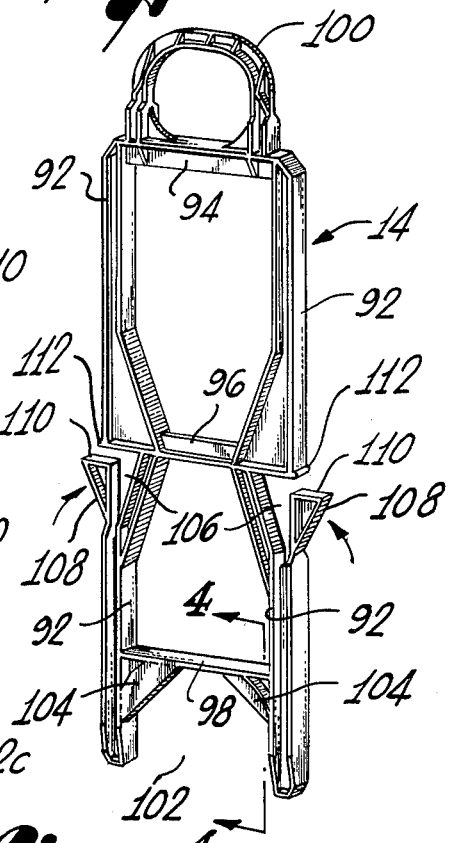
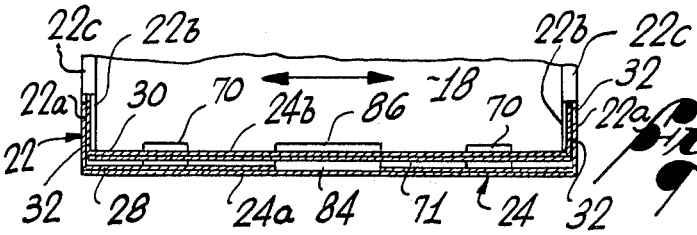
Fig. 6

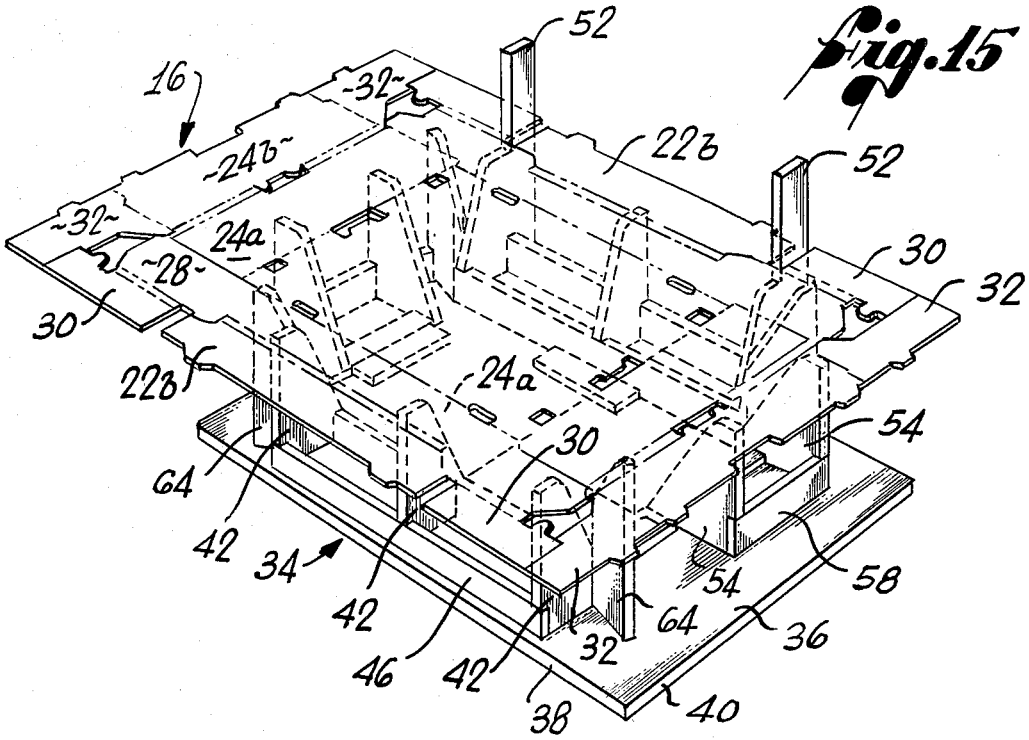
Fig. 15
Fig. 16
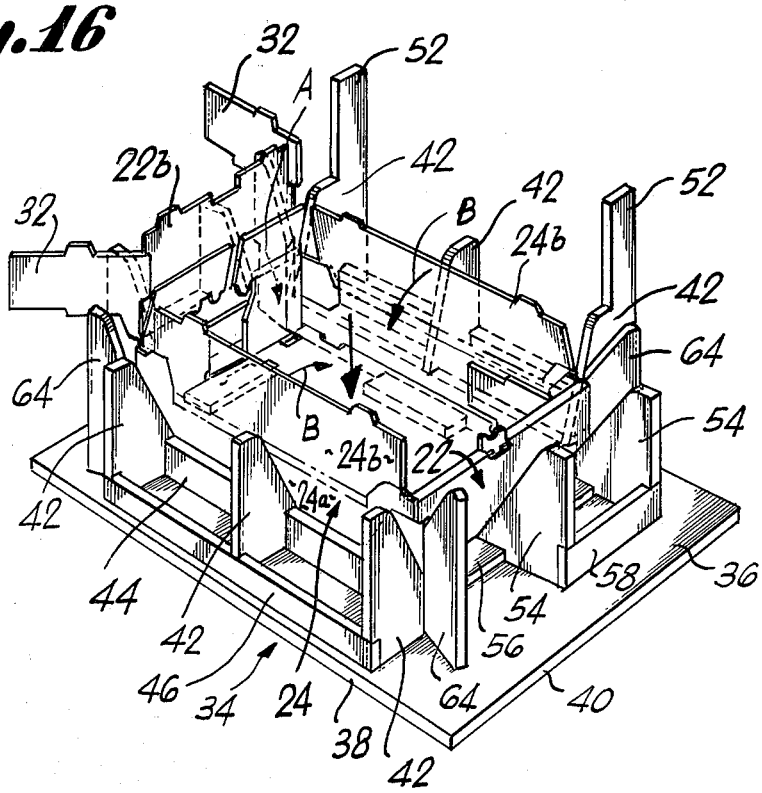

METHOD AND DEVICE FOR FOLDING BLANKS TO FORM BOXES

FIELD OF THE INVENTION

The present invention relates to boxes for produce and the like, and more particularly, to a method and device for folding blanks to form such boxes.

BACKGROUND OF THE DISCLOSURE

When agricultural produce such as grapes and strawberries is picked, it is packed in the field in relatively flat, open-topped trays or boxes. These boxes are stacked on pallets for shipping and storage, a stack often being sixteen, eighteen or more boxes high.

The boxes are consumed in large numbers, running into many millions each growing season, and the cost of packaging must be kept at a minimum. Nevertheless, the boxes must be strong enough to protect the produce against degradation. They should be lightweight and have a large capacity in comparison to their external dimensions.

Generally, the boxes are made from folded paperboard blanks. Prior to folding, the blanks are flat sheets that require comparatively little room and are easily shipped. Once folded, however, they become bulky, are relatively susceptible to damage, and are difficult to ship. For this reason, it is often desired to fold the blanks in the field at the site where produce is to be packed.

Folding of the blanks in the field is generally a labor intensive and, therefore, expensive operation. Moreover, some boxes are folded improperly in the field resulting in a loss of produce. These difficulties have led some growers to use machine folded boxes that are shipped to the packing site in an assembled condition, despite the above-mentioned disadvantages of the approach.

A primary objective of the present invention is to provide a method and device for folding blanks that will permit boxes to be easily, quickly and reliably assembled at the site. A further objective is to provide such a method and device that can be used to assemble improved boxes having increased strength and stacking ability.

SUMMARY OF THE INVENTION

The present invention accomplishes the above objectives and resides in the use of a jig into which a blank is inserted as an aid to achieve proper folding. The blank has side panels, end panels, and supplemental end panels carried by the side panels.

The jig of the invention includes a base and means for properly positioning the blank over the base. Side panel folding surfaces extend upwardly and outwardly to engage and fold the side panels. Similar end panel folding means define end folding surfaces for folding the end panels.

When the blank is pressed into the jig, the side panels are folded upwardly before the end panels and supplemental end panels are folded inwardly. Preferably, the side folding surfaces have lower portions that are vertically oriented and upper portions that are inclined. This structure insures that the side panels are folded before the end panels.

The jig can be used with blanks that are provided with supplemental side panels attached to the end panels. In one embodiment, the jig is provided with corner folding guides that fold these supplemental side panels outwardly and backwardly as the end panels are lifted. The supplemental side panels can then be folded inwardly along the upright side panels.

The method of the invention comprises positioning a blank over the jig and pressing it into the jig to fold it in the manner described above. After the blank has been assembled, column forming inserts can be inserted in the end walls if the box is of an appropriate construction to receive these inserts.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of a stack of three boxes that have been assembled in accordance with the present invention:

FIG. 2 is an enlarged end view of the stack of FIG. 1 after a fourth box has been added, the end walls of some boxes being partially broken-away to expose inserts;

FIG. 3 is a further enlarged perspective view of one insert;

FIG. 4 is a still further enlarged fragmentary cross-sectional view of an insert taken along the line 4—4 of FIG. 3;

FIG. 6 is a fragmentary cross-sectional view of one end of the box without inserts taken along the line 6—6 of FIG. 5;

FIG. 15 is a perspective view of the blank and jig combination of FIG. 14; and FIG. 16 is a perspective view of the blank and jig combination with the blank in a partially folded condition.

DESCRIPTION OF THE PREFERRED EMBODIMENT

An exemplary box 10 assembled in accordance with the present invention includes a folded paperboard container 12 and a pair of plastic inserts 14. A plurality of such boxes 10 can be interlocked and arranged in a stack as shown in FIG. 1.

Figure 5:
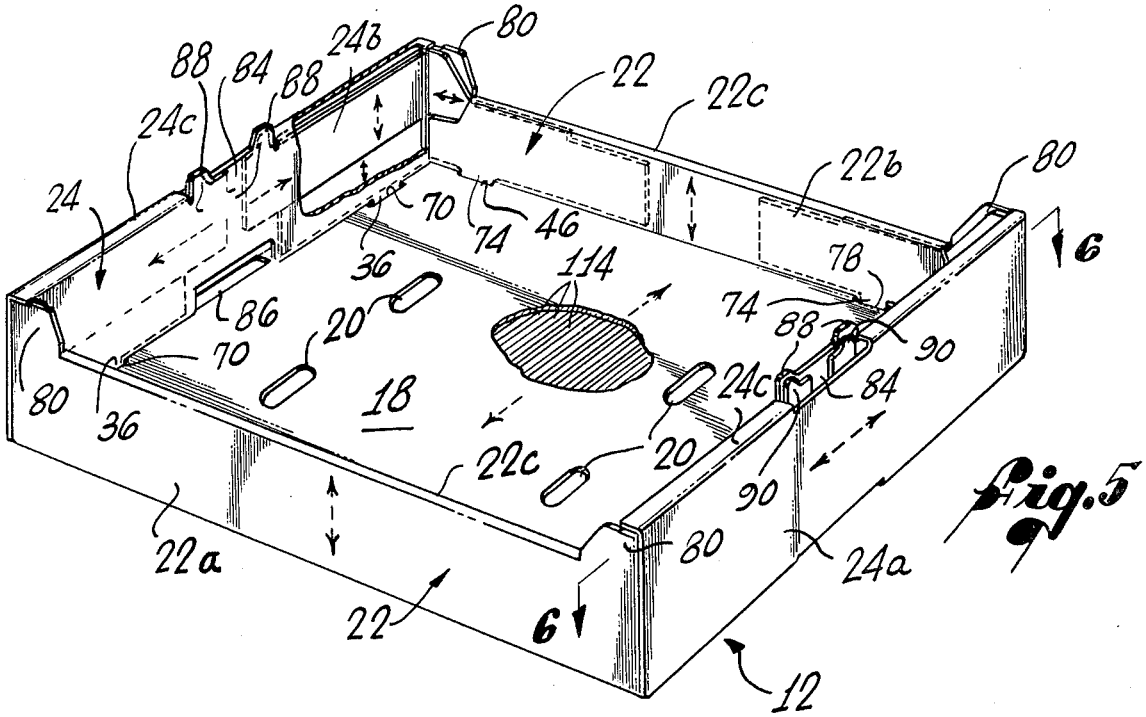
FIG. 5 is a perspective view of one of the boxes without inserts, a portion of the top layer of the floor being broken away to expose the flutes, and a portion of one end wall being broken away to expose its internal structure.
Figure 7:
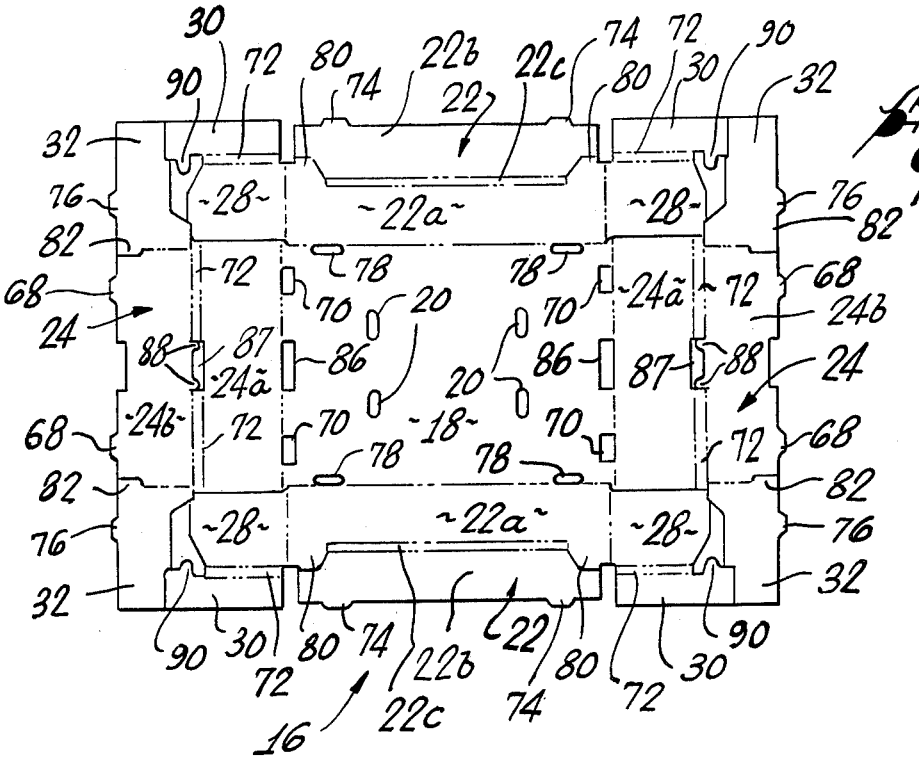
FIG. 7 is a plan view of an unfolded blank from which the box of FIG. 5 is constructed.
Figure 8:
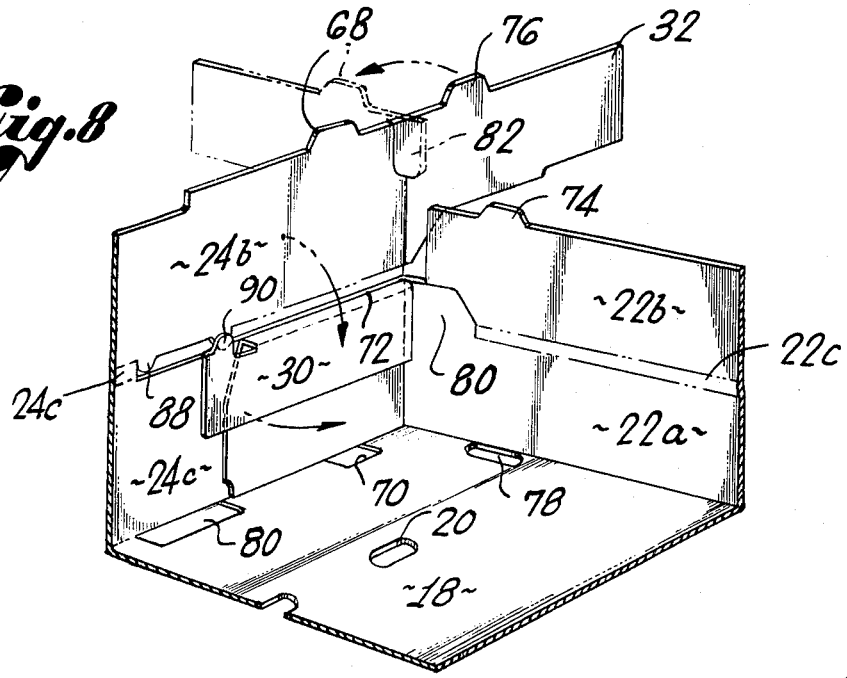
FIGS. 8, 9 and 10 are fragmentary perspective views of a corner of the box in successive stages of assembly.

Each container 12, shown separately in FIG. 5, is formed by folding a single, corrugated blank 16, shown unfolded in FIG. 7. The blank 16 is divided by cut lines and score lines to define a plurality of panels. It includes a relatively large, rectangular floor panel 18 at its center provided with vent holes 20 in the conventional manner. Attached to the longer edges of the floor panel 18 are two sidewalls 22, while two end walls 24 are attached to its shorter edges. Each wall 22, 24 includes an outer panel or portion 22*a*, 24*a* joined directly to the floor panel 18 and an inner panel or portion 22*b*, 24*b* joined to the corresponding outer panel by a long narrow top strip 22*c*, 24*c*. At the corners of the blank 16 are supplemental strengthening panels 28, 30 and 32 that complete its generally rectangular shape. These include inner and outer supplemental end panels 28 and 30 carried by the outer side panel 22*a* and a supplemental side panel 32 attached to the inner end panel 24*b*.

Figure 13:
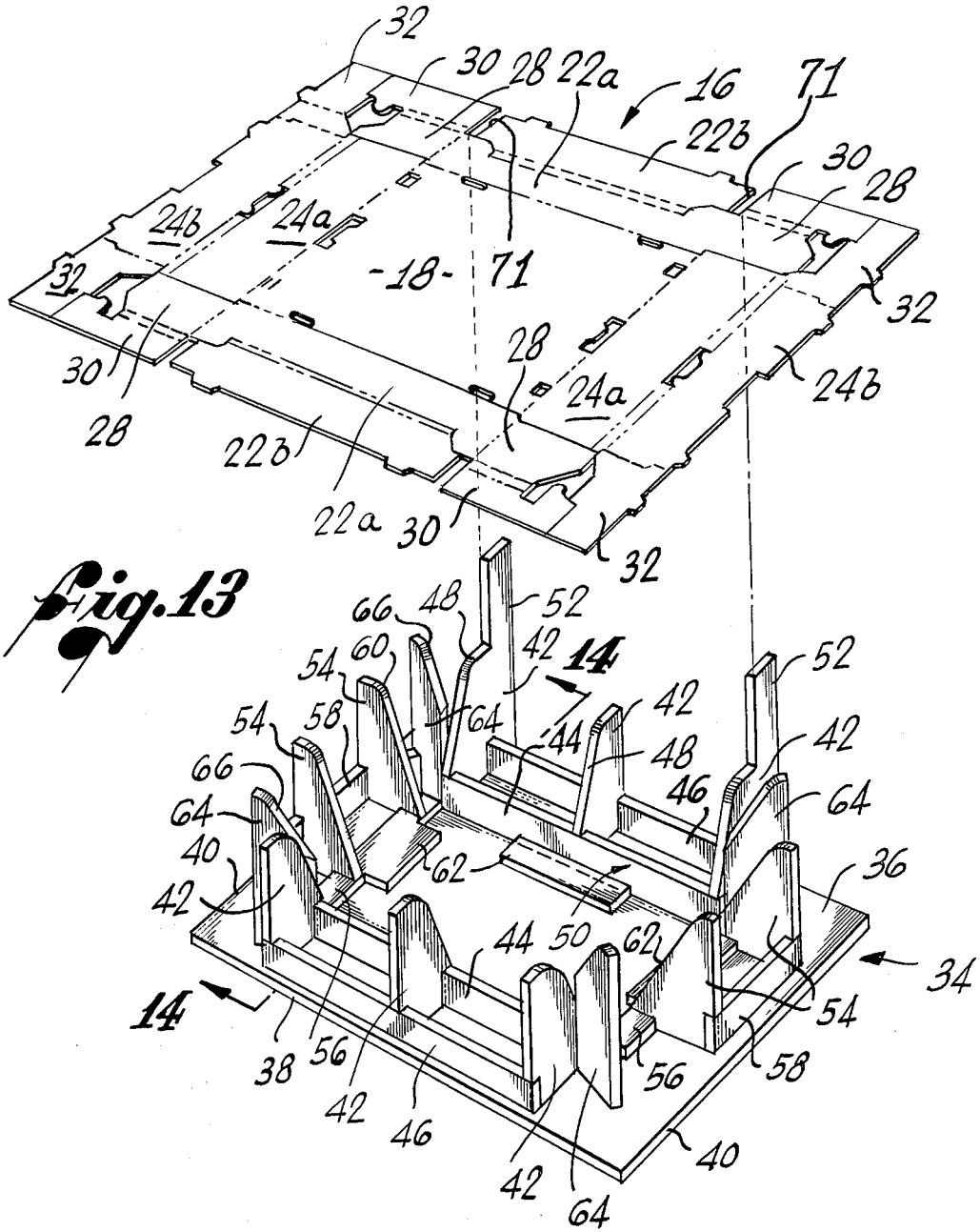
FIG. 13 is a perspective view of the blank of FIG. 7 juxtaposed with respect to a jig constructed in accordance with the invention.

To assemble the container 12, the blank 16 is positioned above a jig 34, as shown in FIG. 13. In general, the jig 13 is made of wood, including a flat, rectangular, horizontal base 36. The base 36 has two parallel sides 38 that are longer than its parallel ends 40.

Arrayed along each side 38 of the base 36 is a row of three upstanding side guides 42 that are parallel to the edges 40 of the base. A pair of side rails 44 and 46 that stand on edge extend parallel to the sides 38 of the base 36 and the side guides 42 are notched at their bottom ends to receive the rails. The side guides are tied to the base 36 by the rails 44 and 46 to form a rigid integral structure.

The side guides 42 have inwardly facing edges 48 that are inclined upwardly and outwardly with respect to the base 36, beginning at the top edge of the innermost rails 44. These edges 48 of each row of guides 42 face the corresponding edges of the guides of the opposite row. Side folding surfaces that engage the blank 16 in the manner explained below are formed by the inclined edges 48 of the side guides 42 and by a pair of inwardly facing horizontal surfaces 50 formed by the innermost side rails 44. In one row of side guides 42, the two outer guides have upward extensions 52 of reduced width that serve to position the blank 16, as explained below.

At each end 40 of the base 36 is a pair of end guides 54 that are parallel to the sides 38 of the base 16. Each end guide 54 is in the general shape of a triangle with a rounded top corner. A pair of end rails 56 and 58 extend parallel to the ends 40 of the base 36 and are received by notches in the end guides 54. The innermost end rails 56 lie flat on the base 36, allowing the end guides 54 to have upwardly and outwardly inclined folding surfaces 60 that extend to a floor level of the jig 34 defined by a plurality of spacers 62.

The jig 34 also includes four corner guides 64 each of which extends vertically from the base 36 at one corner thereof. A forty-five degree angle is formed between each of the corner guides 64 and the adjacent side guides 42 and end guides 54. Each corner guide 64 is higher than the other guides 42 and 54 and has an upwardly and outwardly inclined folding surface 66 that terminates above the lower end of the inclined edges 48 of the side guides 42.

Figure 14:
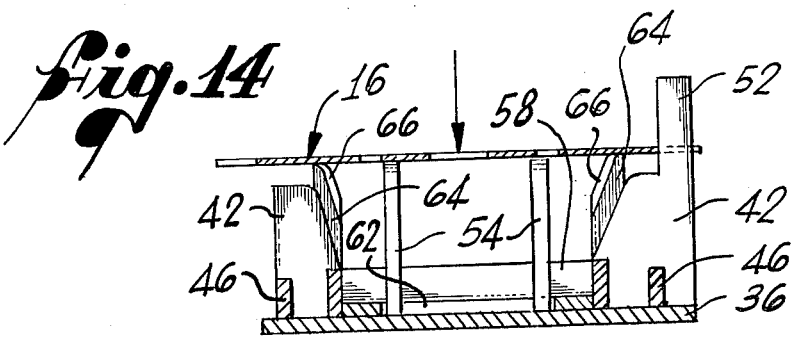
FIG. 14 is a cross-sectional side view of the blank and jig while the blank is engaged by the jig prior to folding.

When the blank 16 is to be folded, it is positioned horizontally above the jig 34, as shown in FIGS. 13 and 14. The positioning members 52 are received by a pair of notches 71 in the blank 16 each notch being formed between one of the inner end wall panels 22*b* and the adjacent outer supplemental end panel 30.

Initially, the blank 16 rests on the corner guides 64 that are the highest points on the jig 34 apart from the positioning members 52. It is then pressed downwardly at its center into the jig 34 and the corner guides 64 fold the supplemental end panels 28 and 30 upwardly and inwardly, inside the end panels 24. Simultaneously the outer supplemental end panels 28 tend to lift the side panels 22 to which they are attached.

Figure 11:
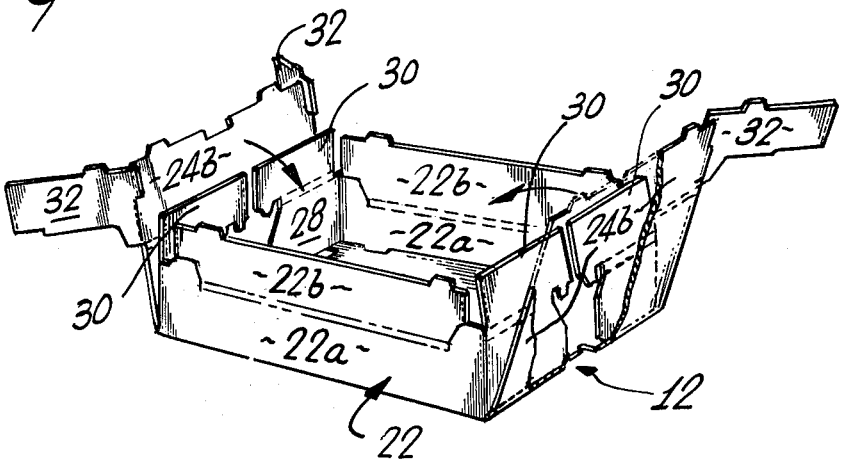
FIGS. 11 and 12 are perspective views of the box in partially assembled conditions.

As the blank 16 moves further downwardly into the jig 34, the inclined folding surfaces 48 and 60 begin to lift the side and end panels 22 and 24 relative to the floor panel 18. The side panels 22 are lifted first because of the more forward positions of the folding surfaces 48 of the side guides 42. Moreover, as the blank 16 approaches the bottom of the jig 34, the vertical folding surfaces 50 of the inner side rails 44 lift the side panels 22 into vertical positions at right angles to the floor panel 18. The end panels 24 remain at an incline and the blank 16 assumes the partially folded position shown (without the jig 34) in FIG. 11. Next, the end panels 24 are hand folded into upright positions, causing the supplemental side panels 32 to be bent backwardly (as shown at the left hand side in FIG. 16) and pushing the supplemental end panels 28 and 30 into positions in which they overlie the inwardly facing surfaces of the end panels 24.

Figure 9:
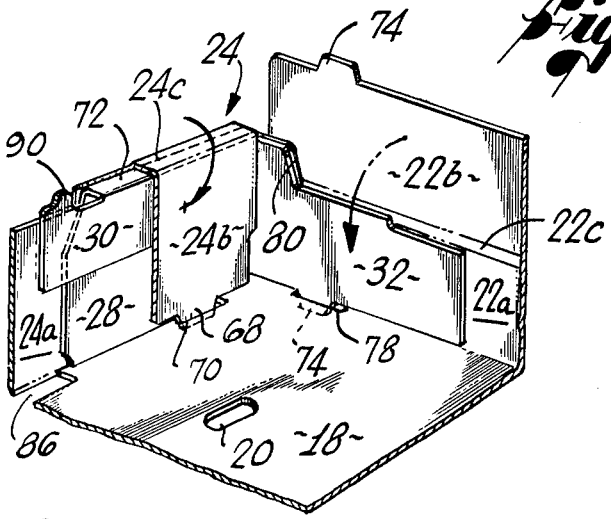

To complete the assembly of the end wall 24, the inner end panels 24*b* are folded down over the supplemental end panels 28 and 30 (as shown in right hand side of FIG. 16) and a pair of holding tabs 68 on its bottom edge are inserted in a set of positioning holes 70 in the floor panel 18 (as best shown in FIG. 9). The inner supplemental end panels 30, joined to the outer supplemental end panels 28 by narrow top strips 72, are thus pushed downwardly 180 degrees into vertical positions.

Figure 12:
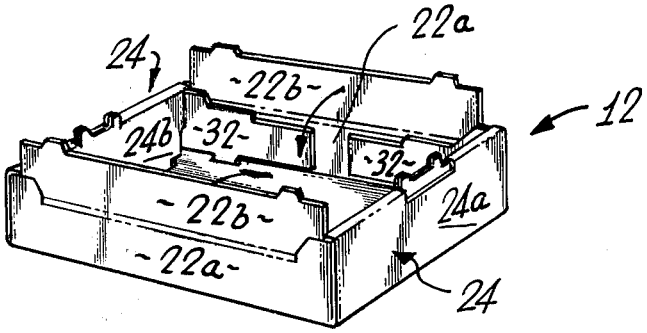

The blank 16 then has the partially assembled configuration shown (without the jig 34) in FIG. 12. The outer end panels 24*a* overlie the outer supplemental end panels 28 while the inner end panels 24*b* overlie the inner supplemental end panels 30. A small narrow space 71 remains between the opposing surfaces of the supplemental end panels 28 and 30, as best shown in FIG. 6. The supplemental side panels 32 now extend from the vertical edges of the inner end panels 24*b* so that they overlie the inwardly facing surfaces of the outer side panels 22*a* (FIG. 9).

Figure 10:
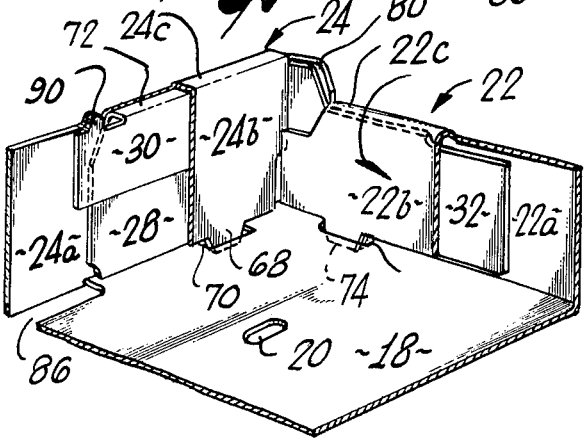

As the last step in assembling the container 12, the inner side panels 22*a* are hand folded down over the supplemental side panels 32 (FIG. 10). Holding tabs 74 and 76 on the lower edges of the inner side panels 22*a* and the supplemental side panels 32 share a common set of positioning holes 78 in the floor panel 18. Although the side walls 22 are generally of lesser height than the end walls 24, the inner sidewall panels 22*b* are notched to accommodate end portions 80 of the outer side panels 22*a* that rise to the full height of the end walls 24.

A fine point of the construction of the container 12 is found in a set of small reinforcing tabs 82 on the vertical edges of the supplemental side panels 32 that extend past the vertical edges of the inner end panels 24*b* and the first and second strengthening panels 28 and 30 to abut the inside surfaces of the outer end panels 24*a*. These reinforcing tabs 82 rigidify the corners of the container 12 by preventing the end walls 24 from bending inwardly.

A vertical slot 84 is formed in each end wall 24 between its inner and outer panels 24*a* and 24*b* (as best shown in FIGS. 5 and 6), these slots being vertically aligned when the containers 12 are stacked. To form the slots 84, openings 86 are provided in the floor panel 18 beneath the center of each end wall 24 and a corresponding opening 87 is cut in the top strip 24*c* of each end wall. The vertical edges of the slots 84 are coincident with the ends of the outer supplemental end panels 28.

Adjacent each end of the slot 50 at the top thereof, small upstanding protrusions 88 and 90 are formed on the top edges of the inner end panels **24*b* and the second strengthening panel 30. When the containers 12 are stacked, these protrusions 88 and 90 fit into the slots 84 of the next container 12 above to inhibit relative lateral shifting between the containers, even before the plastic inserts 14** have been installed.

The inserts 14 for the slots 84, best shown in FIG. 3, are each integrally molded as an open framework. Each includes two vertical side pieces 92 joined by three horizontal cross-pieces 94, 96 and 98 at the top, at the middle and near the bottom. The width of the insert 14, measured from the edge of one side piece 92 to the other is equal to the length of the slot 84 for a tight fit. Its thickness fills the slot 84 between the inner supplemental end panel 30 and the inner end panel **24*b*** to provide a more rigid structure when compared to a more conventional end wall that receives a loose fitting wire as an interlocking device.

An inverted U-shaped member 100 forms a projection with an open center that extends upwardly from the top cross-piece 94 of each insert 14. When the inserts 14 are interlocked, this projection 100 is snugly received by a recess 102 in the insert 14 above. The recess is formed below the bottom cross-piece 98 and between the lower ends of the side pieces 92 (as illustrated in FIG. 2). Once the projection 100 is seated within the recess 102, it is held against rotation about a vertical axis by a pair of corner-spanning restrainers 104 at the intersections of the side pieces 92 with the bottom cross-piece 98 (FIGS. 3 and 4).

Immediately below the middle cross-piece 96, the side pieces 92 are indented to form outwardly facing V-shaped notches 106. At the bottom of each notch 106, the side piece 92 is joined to a V-shaped container support tab 108 that normally extends outwardly from the vertical edge of the side piece and provides an upwardly facing horizontal abutment surface 110. With moderate pressure, the support tabs 108 can be bent inwardly into the notches 106 so they do not extend beyond the edges of the side pieces 92.

A pair of inserts 14 are pressed downwardly into the slots 84 of a container 12, positioning of the inserts being aided by a taper of the lower ends of the side pieces 92. Each insert 14, not including the projection 100 at the top, is approximately twice the height of a single container 12. The tabs 108, being outwardly tapered from the bottom, bend inwardly to pass through the opening 87 at the top of the slot 54 and then spring out again so that the abutment surfaces 110 can engage the under side of the end wall top strips **24*c* to prevent the insert 14 from being withdrawn. When the insert 14 is fully in place, a small horizontal bead 112 on each side piece 92, opposite the middle cross-piece 96 and just above the notch 106, comes to rest on the top strip 24*c* of the end wall 24** to arrest the downward motion.

After another insert 14 has been installed in the opposite end wall 24, a second container 12 may be placed over the exposed upper halves of the insert 14 to rest on the end walls of the container below, forming a single pair of interlocked boxes 10. These two boxes 10 may then be carried as a unit, with the projections 100 on the tops of the inserts 14 serving as handles.

It should be noted that when the boxes 10 are stacked, every other box is supported by the tabs 108 of one of the inserts 14 and not by the box below it. In essence, the inserts 14 form vertical columns from which the containers 12 are hung in pairs. The end walls 14 of the boxes 10 at the bottom of the stack are not crushed by the weight of the boxes above.

Because the end walls 24 need not carry the weight above, it is possible to use blanks 16 in which the flutes 114 run along the end walls and across the floor 18 (FIG. 5) so that each box 10 has improved floor strength to support its own contents. It should also be noted that the outer supplemental end panels 28, being extensions of the outer sidewall panels **22*a*, have their flutes oriented vertically for greater reinforcement of the end walls 24**, especially at the ends, to stabilize the stack.

Preferably, each pair of containers 12, is slightly taller than the inserts 14, excluding the projections 100. Initially, when a stack is formed, a small amount of compression takes place, reducing the end wall height of the containers 12 and permitting the end walls 24 to more effectively resist tipping or wobbling.

It will be readily apparent from the foregoing description that the present invention permits the boxes 10 to be quickly and easily assembled in the field by unskilled workers. No tools are required apart from the jig 34 which has no moving parts. The jig 34 is of inexpensive construction but is rugged and able to withstand abusive treatment.

While a particular form of the invention has been illustrated and described, it will also be apparent that various modifications can be made without departing from the spirit and scope of the invention.

I claim:

1. A jig for folding a blank having side panels, end panels, supplemental side panels attached to said end panels, and supplemental end panels attached to said side panels to form a paperboard box, said jig comprising:

a base;

side panel folding means arranged on opposite sides of said base and defining side folding surfaces that extend upwardly and outwardly from said base for engaging and folding said side panels;

end panel folding means arranged at opposite ends of said base and defining end folding surfaces that extend upwardly and outwardly from said base for engaging and folding said end panels, said end folding surfaces raising less steeply from said base than said side folding surfaces, whereby said side panels are folded upwardly before said end panels as said blank is pressed into said jig; and corner guide means for engaging and folding said supplemental end panels upwardly with respect to the associated side panels prior to engagement of said side panels with side folding surfaces whereby said supplemental end panels are folded inwardly of said end panels, and for folding said supplemental side panels outwardly with respect to the associated end panels as said blank is pressed downwardly into said jig.

2. The jig of claim 1 further comprising:

positioning means supported by said base for positioning said blank over said base in a predetermined orientation.

3. The jig of claim 1 wherein said side folding surfaces have vertical lower portions perpendicular to said base.

4. The jig of claim 1 wherein said side folding surfaces have outwardly inclined upper portions.

5. The jig of claim 1 wherein said side panel folding means includes two sets of side guides, said side guides of each set being arranged parallel to each other along one side of said base.

6. The jig of claim 5 further comprising positioning means formed by upward extensions of said side guides for positioning said blank over said base in a predetermined orientation.

7. The jig of claim 5 wherein said end panel folding means includes two sets of end guides, said end guides of each set being arranged parallel to each other along one edge of said base.

8. The jig of claim 1 wherein said corner guide means rise above said side folding surfaces.

9. The jig of claim 8 wherein said corner guide means includes supplemental end panel folding surfaces that extend upwardly and outwardly with respect to said base.

10. A method for folding a blank having side panels, end panels, supplemental side panels attached to said end panels, and supplemental end panels attached to said side panels, said method comprising the steps of:

positioning said blank horizontally over a jig having a plurality of folding surfaces;

pressing said blank downwardly into said jig to engage said folding surfaces, thereby in sequence folding said supplemental end panels upwardly with respect to the associated side panels, folding said side panels and said end panels upwardly, said side panels being folded ahead of said end panels thereby positioning said supplemental end panels inside said end panels, said end panels engaging said supplemental end panels, and folding said supplemental side panels outwardly with respect to said end panels; and folding portions of said end panels downwardly over said supplemental end panels and thereby positioning said supplemental side panels along side of and inside said side panels.

11. A jig for folding a blank having side panels, end panels, supplemental side panels attached to said end panels and supplemental end panels attached to said side panels, said jig comprising:

a base;

positioning means supported by said base for horizontally positioning said blank over said base in a predetermined manner;

side panel folding guides arranged on opposite sides of said base and defining side folding surfaces that extend upwardly and outwardly from said base;

end panel folding guides arranged at opposite ends of said base and defining end folding surfaces that extend upwardly and outwardly from said base at an angle less steeply than said side folding surfaces whereby said side panels are folded upwardly before said end panels; and corner guide means for folding said supplemental end panels upwardly with respect to the associated side panels prior to engagement of said side panels with said side folding surfaces whereby said supplemental end panels are folded inwardly of said end panels and for folding said supplemental side panels outwardly with respect to the associated end panels as said blank is pressed downwardly into said jig.

12. The jig claim of 11 wherein said side folding surfaces have vertical lower portions perpendicular to said base.

13. The jig of claim 11 wherein said corner guide means rise above said side folding surfaces.

14. The jig of claim 11 wherein said corner guide means include folding surfaces that extend upwardly and outwardly with respect to said base.

15. The jig of claim 11 wherein said positioning means is formed by upward extensions of said side panel folding guides dimensioned to be received between said side panels and said supplemental end panels.

16. A jig for folding a blank having side panels, end panels, supplemental side panels attached to said end panels and supplemental end panels attached to said side panels, said jig comprising:

a rectangular horizontal base;

side panel folding means for defining side folding surfaces that include lower portions perpendicular to said base and upper portions extending upwardly and outwardly with respect to said base;

said side panel folding means including two sets of side guides, said guides of each set being arranged parallel to each other along one side of said base;

end panel folding means arranged at opposite ends of said base and defining end folding surfaces that extend upwardly and outwardly from said base, said end panel folding means including two sets of generally triangular end guides, said end guides of each set being arranged parallel to each other;

four corner guide means forming equal angles with said side guides and said end guides for folding said supplemental end panels inwardly and said supplemental side panels outwardly; and positioning means formed by upward extensions of some of said guides and dimensioned to be received between said side panels and said supplemental end panels for horizontally positioning said blank with respect to said base in a predetermined manner;

whereby said side panels are folded upwardly before said end panels, said supplemental end panels are folded inwardly of said end panels and said supplemental side panels are folded outwardly as said blank is pressed downwardly into said jig.

17. A method of folding a blank having side panels, end panels, supplemental side panels attached to said end panels, and supplemental end panels attached to said side panels, said method comprising the steps of:

positioning said blank over a jig having a plurality of folding surfaces; and pressing said blank into said jig to engage said folding surfaces, thereby folding said side panels, said supplemental end panels, said end panels, and said supplemental side panels, said supplemental end panels being folded upwardly from said side panels prior to upward folding of said side panels, said side panels being folded upwardly ahead of said end panels whereby said supplemental end panels are positioned inwardly with respect to said end panels, and said end panels are folded upwardly and said supplemental side panels are folded outwardly with respect to the associated end panels, said end panels engaging said supplemental end panels and folding said supplemental end panels inwardly.

18. The method of claim 17 comprising the further step of folding said end panels over said supplemental end panels to define inner and outer portions of said end panels.

19. The method of claim 18 comprising the further step of positioning column forming inserts between said inner and outer portions of said end panels.

* * * * *